US009343037B2

(12) United States Patent
Hirota

(10) Patent No.: US 9,343,037 B2
(45) Date of Patent: May 17, 2016

(54) DATA TRANSMISSION METHOD AND DISPLAY DEVICE

(75) Inventor: Eiji Hirota, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 443 days.

(21) Appl. No.: 13/991,232

(22) PCT Filed: Nov. 25, 2011

(86) PCT No.: PCT/JP2011/077155

§ 371 (c)(1),
(2), (4) Date: Jun. 3, 2013

(87) PCT Pub. No.: WO2012/073809

PCT Pub. Date: Jun. 7, 2012

(65) Prior Publication Data

US 2013/0257881 A1 Oct. 3, 2013

(30) Foreign Application Priority Data

Dec. 2, 2010 (JP) ..... 2010-269025

(51) Int. Cl.
*G09G 3/36* (2006.01)
*G09G 5/00* (2006.01)

(52) U.S. Cl.
CPC ..... *G09G 5/003* (2013.01); *G09G 3/3614* (2013.01); *G09G 3/3648* (2013.01); *G09G 3/3688* (2013.01); *G09G 2310/027* (2013.01); *G09G 2330/021* (2013.01); *G09G 2370/08* (2013.01)

(58) Field of Classification Search
CPC ..... G09G 2310/0289; G09G 2310/027; G09G 3/3688; G09G 3/2011; G09G 3/20; G09G 2310/0297; G09G 2310/0218; G09G 3/3677; G09G 2320/0242; G09G 2320/0247; G09G 2320/0261; G09G 2320/0266; G09G 2360/18; G09G 3/2022; G09G 3/3611; G09G 3/3614; G09G 3/3648; G06F 13/385; G06F 13/4286; G06F 11/267; G06F 12/1408; G06F 15/17375; G06F 2003/0698; G06F 21/445; G06F 21/57; G06F 21/606; G06F 21/72; G06F 21/73; G06F 21/75; G06F 21/85; G06F 2221/2103; G06F 7/588; G06F 3/05; G06F 7/586
See application file for complete search history.

(56) References Cited

U.S. PATENT DOCUMENTS

| | | | | |
|---|---|---|---|---|
| 8,659,647 | B2 * | 2/2014 | Segawa | 348/65 |
| 8,831,112 | B2 * | 9/2014 | Maeda | 375/257 |
| 2008/0252635 | A1 * | 10/2008 | Kim et al. | 345/214 |
| 2009/0268824 | A1 | 10/2009 | Fukuda | |

FOREIGN PATENT DOCUMENTS

JP 2009-267624 A 11/2009

OTHER PUBLICATIONS

International Search Report and Written Opinion corresponding to PCT/JP2011/077155, dated Jan. 17, 2012.

* cited by examiner

*Primary Examiner* — Duc Dinh
(74) *Attorney, Agent, or Firm* — Hauptman Ham, LLP

(57) ABSTRACT

Provided is a method capable of performing serial transmission of data whose data values change in short fixed cycles, while suppressing an increase in power consumption. In a liquid crystal controller, data sequence conversion is performed on data included in an input image signal by a first data sequence conversion circuit and a second data sequence conversion circuit every predetermined period of time. The data sequence conversion is performed by reversing the values of predetermined bits of each data. The data obtained after the data sequence conversion is transmitted, as a digital video signal, to a source driver. In the source driver, the same data sequence conversion as that performed by the liquid crystal controller is performed on each data included in the digital video signal by a first data sequence restoring circuit and a second data sequence restoring circuit.

6 Claims, 10 Drawing Sheets

-- Prior Art --

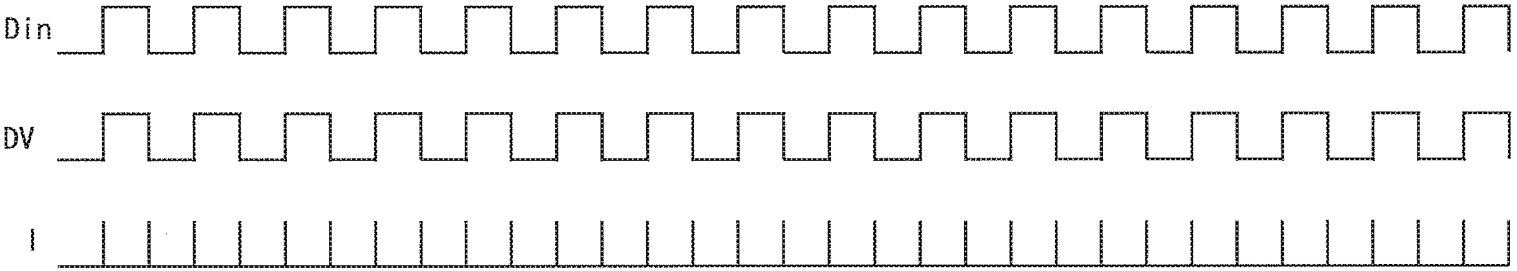
Fig.11 -- Prior Art --

DATA TRANSMISSION METHOD AND DISPLAY DEVICE

RELATED APPLICATIONS

The present application is a National Phase Application of International Application Number PCT/JP2011/077155, Nov. 25, 2011, and claims priority from Japanese Application Number 2010-269025, filed Dec. 2, 2010.

TECHNICAL FIELD

The present invention relates to a data transmission method, and more particularly to a method of transmitting an image signal in a display device.

BACKGROUND ART

A common liquid crystal display device is provided with one or a plurality of drivers for driving a liquid crystal panel (hereinafter, referred to as the "liquid crystal drivers"); and a liquid crystal controller for controlling the operation of the liquid crystal drivers, based on an image signal (hereinafter, referred to as the "input image signal") and synchronizing signals, which are sent from an external source. For the liquid crystal drivers, typically, a gate driver (scanning signal line drive circuit) for driving gate bus lines (scanning signal lines) in the liquid crystal panel, and a source driver (video signal line drive circuit) for driving source bus lines (video signal lines) in the liquid crystal panel are provided in the liquid crystal display device.

FIG. 10 is a block diagram for describing transmission of image data in a liquid crystal display device. An input image signal Din which is image data is provided to a liquid crystal controller 91 from an external source. Then, the liquid crystal controller 91 performs timing adjustments and the like, and a digital form signal (hereinafter, referred to as the "digital video signal") DV which is generated based on the input image signal Din is transmitted from the liquid crystal controller 91 to a source driver 92. As for the method of transmitting the digital video signal DV from the liquid crystal controller 91 to the source driver 92, typically, serial transmission is adopted where data is transmitted bit by bit using one signal line. The source driver 92 applies a video signal which is a voltage signal to each source bus line, based on the digital video signal DV sent from the liquid crystal controller 91.

Meanwhile, display devices such as liquid crystal display devices conventionally have the problem of a reduction in power consumption. Hence, a reduction is also intended for power consumption for data transmission. For example, according to the invention disclosed in Japanese Patent Application Laid-Open No. 2009-267624, in order to achieve a reduction in power consumption for serial transmission, data transmission is performed such that the same amplitude value is not taken consecutively and the polarity of an amplitude value is reversed every cycle.

PRIOR ART DOCUMENT

Patent Document

[Patent Document 1] Japanese Patent Application Laid-Open No. 2009-267624

SUMMARY OF THE INVENTION

Problems to be Solved by the Invention

In serial transmission, data is transmitted bit by bit as described above, and the higher the number of reversals of the values of bits performed during data transmission, the higher the power consumption. This is because a current occurs in a circuit according to a change in the value of a bit. Hence, when transmission of data whose data values change regularly in short fixed cycles, such as data on a still image, is performed in a display device, power consumption increases. For example, in the configuration shown in FIG. 10, when an input image signal having a waveform indicated by the symbol "Din" in FIG. 11 is provided to the liquid crystal controller 91, a digital video signal having a waveform indicated by the symbol "DV" in FIG. 11 is transmitted from the liquid crystal controller 91 to the source driver 92. At this time, current peaks occur in short fixed cycles, as indicated by the symbol "I" in FIG. 11. As a result, power consumption increases. Even by the invention disclosed in Japanese Patent Application Laid-Open No. 2009-267624, only a reversal of data values is performed and the frequency of a signal to be transmitted does not change. Thus, when transmission of data whose data values change regularly in short fixed cycles is performed, a great effect of reducing power consumption cannot be obtained.

An object of the present invention is therefore to provide a method that can perform serial transmission of data whose data values change in short fixed cycles, while suppressing an increase in power consumption.

Means for Solving the Problems

A first aspect of the present invention is directed to a data transmission method for performing serial transmission of data including unit data constituted by n bits (n is an integer greater than or equal to 2) from a transmitting unit to a receiving unit, the method comprising:

a data sequence conversion step of performing a first reversal process on transmission target data based on a predetermined reversal rule for identifying a bit whose value is to be reversed among the n bits constituting the unit data, the first reversal process reversing values of at least one and less than n bits on a unit-data-by-unit-data basis, the transmission target data being data provided to the transmitting unit or data generated by the transmitting unit;

a data transmission step of transmitting the data obtained in the data sequence conversion step from the transmitting unit to the receiving unit; and a data sequence restoring step of performing a second reversal process on the data transmitted to the receiving unit in the data transmission step, the second reversal process reversing, on a unit-data-by-unit-data basis, the values of the bits having been subjected to the reversal of the values in the first reversal process.

According to a second aspect of the present invention, in the first aspect of the present invention, the data transmission method further comprises a bit addition step of adding, on a unit-data-by-unit-data basis, an identification bit having a value according to the reversal rule used in the first reversal process, wherein in the data sequence restoring step, the second reversal process is performed based on the reversal rule according to the value of the identification bit added to the unit data.

According to a third aspect of the present invention, in the first aspect of the present invention, a plurality of reversal rules, each of which is identical to the reversal rule, are predetermined, and in the data sequence conversion step, the first reversal process is performed by sequentially using the plurality of reversal rules every predetermined period of time.

According to a fourth aspect of the present invention, in the first aspect of the present invention, the data transmission method further comprises a data determination step of determining content of the transmission target data, wherein whether to perform the first reversal process in the data sequence conversion step and the second reversal process in the data sequence restoring step is switched according to a result obtained in the data determination step.

A fifth aspect of the present invention is directed to a display device comprising:

a video signal line drive circuit that drives a plurality of video signal lines for transmitting a video signal; and a control circuit that performs serial transmission of image data including unit data constituted by n bits (n is an integer greater than or equal to 2) to the video signal line drive circuit, wherein the control circuit includes a data sequence conversion circuit that performs a first reversal process on the image data based on a predetermined reversal rule for identifying a bit whose value is to be reversed among the n bits constituting the unit data, the first reversal process reversing values of at least one and less than n bits on a unit-data-by-unit-data basis, and the video signal line drive circuit includes a data sequence restoring circuit that performs a second reversal process on the image data transmitted from the control circuit, the second reversal process reversing, on a unit-data-by-unit-data basis, the values of the bits having been subjected to the reversal of the values in the first reversal process.

According to a sixth aspect of the present invention, in the fifth aspect of the present invention, the control circuit further includes a bit adding unit that adds, on a unit-data-by-unit-data basis, an identification bit having a value according to the reversal rule used in the first reversal process, the video signal line drive circuit further includes a bit value determining unit that determines the value of the identification bit added to the unit data, and in the video signal line drive circuit, the second reversal process is performed by a data sequence restoring circuit selected based on a result of the determination made by the bit value determining unit.

According to a seventh aspect of the present invention, in the fifth aspect of the present invention, the control circuit includes a plurality of data sequence conversion circuits that perform the first reversal process based on different reversal rules, the video signal line drive circuit includes a plurality of data sequence restoring circuits having a one-to-one correspondence with the plurality of data sequence conversion circuits, in the control circuit, the first reversal process is performed such that the plurality of data sequence conversion circuits are sequentially selected every predetermined period of time, and in the video signal line drive circuit, when the second reversal process is performed on each unit data, one of the data sequence restoring circuits corresponding to the data sequence conversion circuit selected by the control circuit is selected.

According to an eighth aspect of the present invention, in the fifth aspect of the present invention, the control circuit further includes a data determining unit that determines content of the image data, and whether to perform the first reversal process by the data sequence conversion circuit and the second reversal process by the data sequence restoring circuit is switched according to a result obtained by the data determining unit.

Effects of the Invention

According to the first aspect of the present invention, when serial transmission of data is performed, the transmitting unit performs the process of reversing the values of predetermined bits on a unit-data-by-unit-data basis, the unit data constituting transmission target data. Hence, when transmission target data is data whose data values change regularly in short fixed cycles, the transmission target data can be converted to data with fewer changes in data value, and the data obtained after the conversion can be transmitted from the transmitting unit to the receiving unit. By this, upon serial transmission of data, the frequency of the occurrence of current peaks is reduced and thus an increase in power consumption is suppressed.

According to the second aspect of the present invention, an identification bit having a value for identifying the content of a process performed in the transmitting unit is added to transmission target data, and the receiving unit performs a process based on the value of the identification bit. By this, data having been subjected to conversion by the transmitting unit can be reliably restored by the receiving unit.

According to the third aspect of the present invention, the occurrence of current peaks resulting from data transmission can be effectively dispersed.

According to the fourth aspect of the present invention, whether to perform the process of reversing the values of bits can be switched according to the content of transmission target data. By this, the load on the transmitting unit and the receiving unit is reduced.

According to the fifth aspect of the present invention, upon transmission of image data from the control circuit to the video signal line drive circuit in the display device, the control circuit performs the process of reversing the values of predetermined bits on a unit-data-by-unit-data basis, the unit data constituting the image data. Hence, when image data to be transmitted is data whose data values change regularly in short fixed cycles, the image data can be converted to data with fewer changes in data value, and the data obtained after the conversion can be transmitted from the control circuit to the video signal line drive circuit. By this, the frequency of the occurrence of current peaks resulting from transmission of image data is reduced and thus an increase in power consumption is suppressed.

According to the sixth aspect of the present invention, in the display device, an identification bit having a value for identifying the content of a process performed in the control circuit is added to image data, and the video signal line drive circuit performs a process based on the value of the identification bit. By this, image data having been subjected to conversion by the control circuit can be reliably restored by the video signal line drive circuit.

According to the seventh aspect of the present invention, the occurrence of current peaks resulting from transmission of image data between the control circuit and the video signal line drive circuit in the display device can be effectively dispersed.

According to the eighth aspect of the present invention, whether to perform the process of reversing the values of bits can be switched according to the content of image data. By this, the load on the control circuit and the video signal line drive circuit is reduced.

BRIEF DESCRIPTION OF THE DRAWINGS

FIG. 11 is a signal waveform diagram for describing a problem in the conventional example.

MODE FOR CARRYING OUT THE INVENTION

<1. Overall Configuration and Operation>

Figure 2:
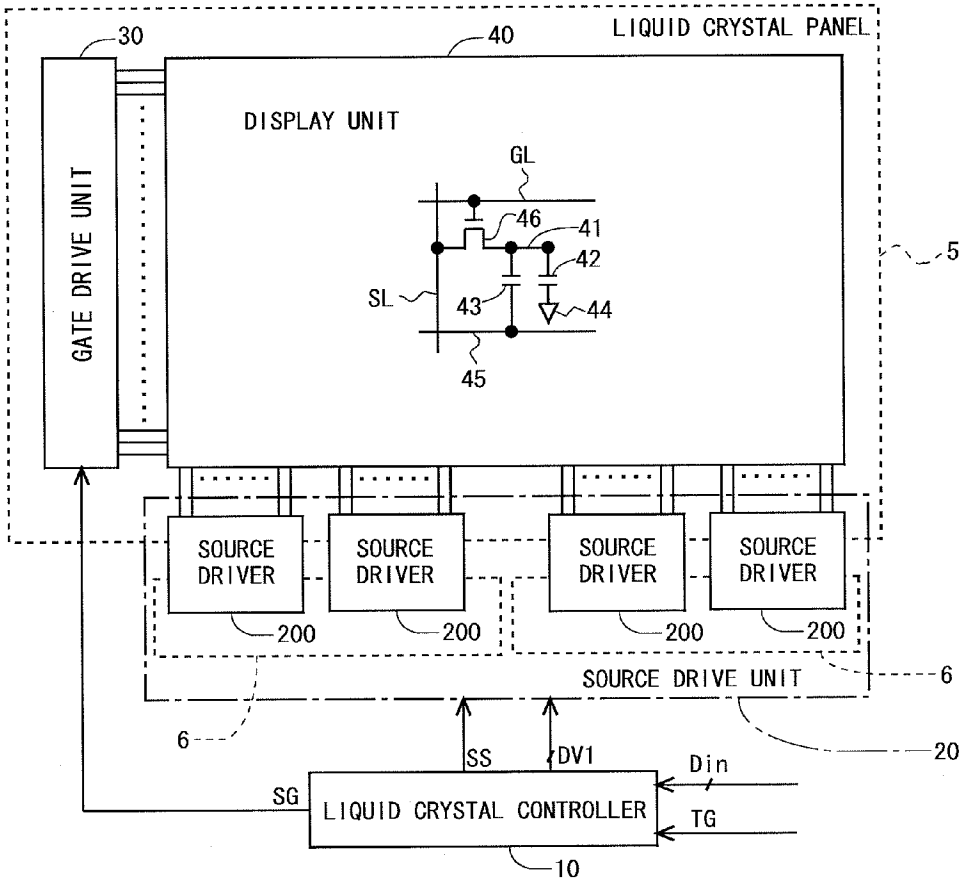
FIG. 2 is a block diagram showing an overall configuration of the liquid crystal display device according to the embodiment.

FIG. 2 is a block diagram showing an overall configuration of a liquid crystal display device according to an embodiment of the present invention. As shown in FIG. 2, the liquid crystal display device includes a liquid crystal controller (control circuit) 10; a source drive unit 20 including a plurality of source drivers (video signal line drive circuits) 200 in IC chip form; a gate drive unit 30; and a display unit 40. The gate drive unit 30 and the display unit 40 are included in a liquid crystal panel 5. Specifically, the gate drive unit 30 is monolithically formed on a glass substrate in the liquid crystal panel 5. The input terminals of the source drivers 200 are connected to terminals on a source board 6 which is implemented by a PCB (Printed Circuit Board) or the like, and the output terminals of the source drivers 200 are connected to terminals in the liquid crystal panel 5. Note that the source drive unit 20 and the gate drive unit 30 may be implemented by schemes other than that described above.

The display unit 40 includes a plurality of source bus lines (video signal lines) SL; a plurality of gate bus lines (scanning signal lines) GL; and a plurality of pixel formation portions provided at the respective intersections of the source bus lines and the gate bus lines. The plurality of pixel formation portions are arranged in matrix, forming a pixel array. Each pixel formation portion includes a TFT 46 which is a switching element connected at its gate terminal to a gate bus line GL passing through a corresponding intersection, and connected at its source terminal to a source bus line SL passing through the intersection; a pixel electrode 41 connected to the drain terminal of the TFT 46; a common electrode 44 and an auxiliary capacitance electrode 45 which are provided to the plurality of pixel formation portions in a shared manner; a liquid crystal capacitance 42 formed by the pixel electrode 41 and the common electrode 44; and an auxiliary capacitance 43 formed by the pixel electrode 41 and the auxiliary capacitance electrode 45. A pixel capacitance is formed by the liquid crystal capacitance 42 and the auxiliary capacitance 43. Note that in the display unit 40 of FIG. 2, only those components corresponding to one pixel formation portion are shown.

The liquid crystal controller 10 receives an input image signal Din which is image data and timing signals TG such as a horizontal synchronizing signal and a vertical synchronizing signal, and outputs a digital video signal DV1, source control signals SS which are a plurality of signals (a source start pulse signal, a source clock signal, a latch strobe signal, and the like) for controlling the operation of the source drive unit 20, and gate control signals SG which are a plurality of signals (a gate start pulse signal, a gate clock signal, and the like) for controlling the operation of the gate drive unit 30. Each source driver 200 in the source drive unit 20 receives the digital video signal DV1 and the source control signals SS which are outputted from the liquid crystal controller 10, and applies a driving video signal to each source bus line. The gate drive unit 30 repeats the application of an active scanning signal to each gate bus line in cycles of one vertical scanning period, based on the gate control signals SG outputted from the liquid crystal controller 10.

By applying the driving video signal to each source bus line and applying the scanning signal to each gate bus line in the above-described manner, an image based on the input image signal Din is displayed on the display unit 40.

<2. Data Transmission Method>

Next, a method of transmitting image data from the liquid crystal controller 10 to each source driver 200 will be described. As for the transmission of image data, serial transmission is performed. The liquid crystal controller 10 functions as a transmitting unit, and the source driver 200 functions as a receiving unit. In the present embodiment, image data is first provided, as an input image signal Din, to the liquid crystal controller 10 and is then transmitted, as a digital video signal DV1, from the liquid crystal controller 10 to the source driver 200. Note that, in the following description, it is assumed that each data included in the input image signal Din is constituted by 8 bits. Such a set of data constituted by 8 bits is hereinafter also referred to as "unit data". The term "data sequence" as used in the following description refers to how the values (0 or 1) of a plurality of bits constituting unit data (here, 8-bit data) are sequenced.

Figure 1:
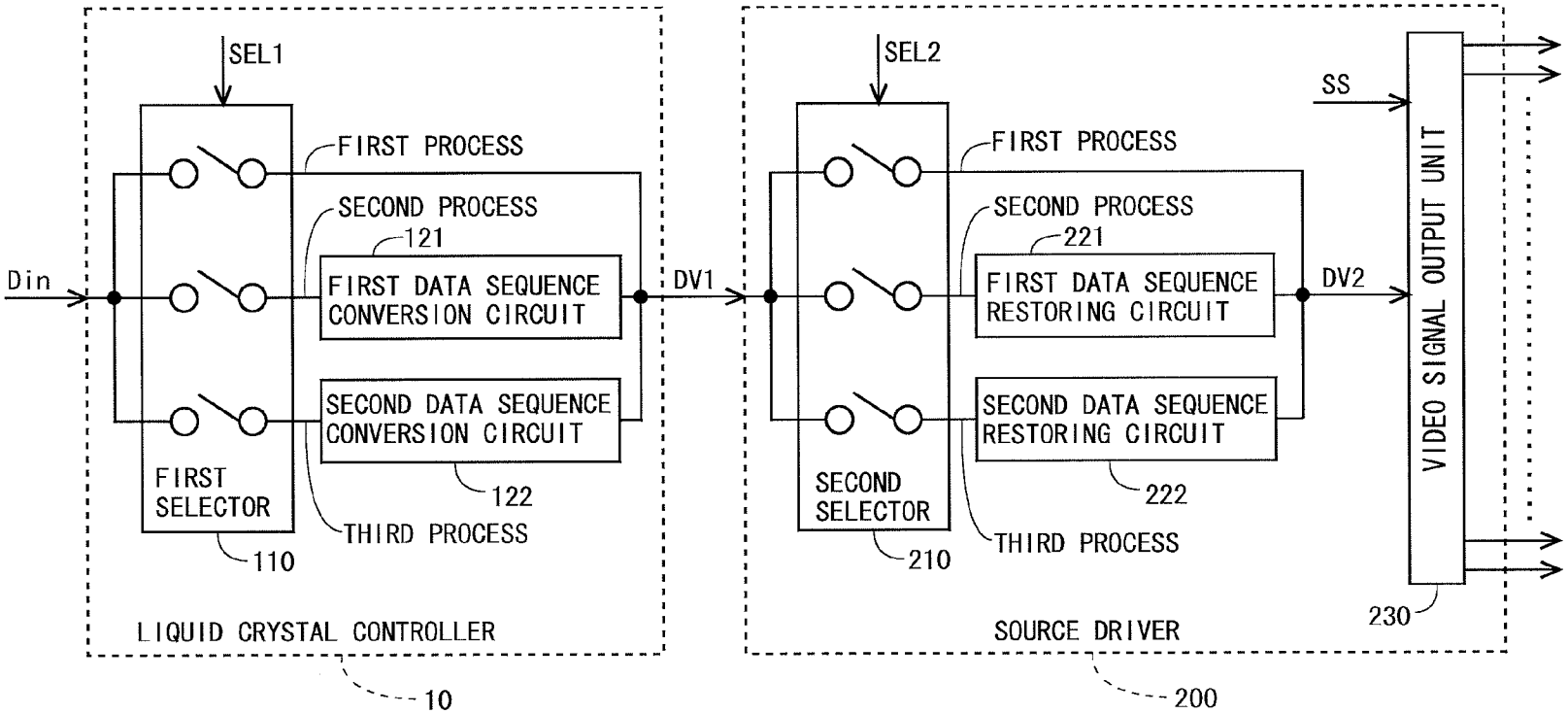
FIG. 1 is a block diagram showing a configuration of the main part related to the transmission of a digital video signal from a liquid crystal controller to a source driver in a liquid crystal display device according to an embodiment of the present invention.

FIG. 1 is a block diagram showing a configuration of the main part related to the transmission of a digital video signal DV1 from the liquid crystal controller 10 to a source driver 200. The liquid crystal controller 10 includes a selector 110, a first data sequence conversion circuit 121, and a second data sequence conversion circuit 122. The source driver 200 includes a selector 210, a first data sequence restoring circuit 221, and a second data sequence restoring circuit 222. Note that, in the following description, the selector 110 in the liquid crystal controller 10 is referred to as the "first selector" and the selector 210 in the source driver 200 is referred to as the "second selector".

<2.1 Operation Performed in the Liquid Crystal Controller>

First, the operation of each component in the liquid crystal controller 10 will be described. The first selector 110 switches the process for an input image signal Din between the following three processes. When a first process is selected, data sequence conversion is not performed on the input image signal Din, and the input image signal Din is transmitted, as a digital video signal DV1, to the source driver 200 in its original data sequence. When a second process is selected, the input image signal Din is provided to the first data sequence conversion circuit 121. The first data sequence conversion circuit 121 performs a reversal of the values of the even bits on each unit data (8-bit data) included in the input image signal Din. Specifically, when taking a look at the values of the even bits of unit data, if a value is 0 the value is converted to 1, and if a value is 1 the value is converted to 0. In the second process, a signal obtained by thus performing data sequence conversion on the input image signal Din is transmitted, as a digital video signal DV1, to the source driver 200. When a third process is selected, the input image signal Din is provided to the second data sequence conversion circuit 122. The second data sequence conversion circuit 122 performs a reversal of the values of the upper 4 bits on each unit data (8-bit data) included in the input image signal Din. Specifically, when taking a look at the values of the upper 4 bits of unit data, if a value is 0 the value is converted to 1, and if a value is 1 the value is converted to 0. In the third process, a signal obtained by thus performing data sequence conversion on the input image signal Din is transmitted, as a digital video signal DV1, to the source driver 200.

Figure 3:
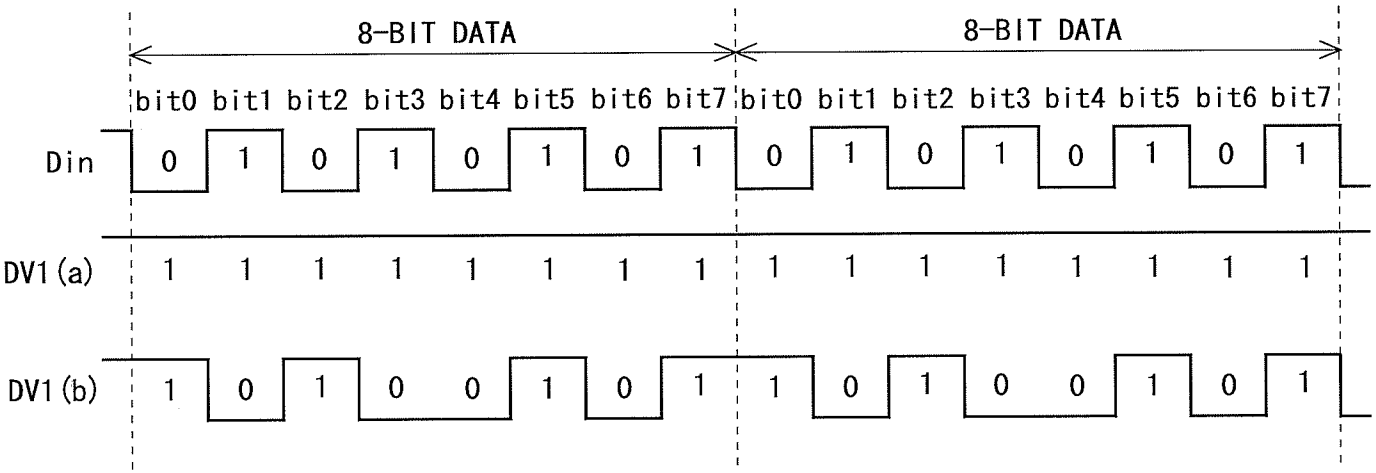
FIG. 3 is a signal waveform diagram for describing processes performed by a first data sequence conversion circuit and a second data sequence conversion circuit in the embodiment.

For example, in the case where an input image signal having a waveform indicated by the symbol "Din" in FIG. 3 is provided to the liquid crystal controller 10, when data sequence conversion is performed by the first data sequence conversion circuit 121, a digital video signal having a waveform indicated by the symbol "DV1(*a*)" in FIG. 3 is transmitted to the source driver 200, and when data sequence conversion is performed by the second data sequence conversion circuit 122, a digital video signal having a waveform indicated by the symbol "DV1(*b*)" in FIG. 3 is transmitted to the source driver 200.

Note that, in the present embodiment, in the first data sequence conversion circuit 121 the values of the even bits of each unit data are reversed, and in the second data sequence conversion circuit 122 the values of the upper 4 bits of each unit data are reversed. However, the present invention is not limited thereto. The values of any of the bits in unit data may be reversed by employing a configuration including a circuit (data sequence conversion circuit) that performs a data sequence conversion process (the process of reversing the values of bits) according to a reversal rule, on the condition that the reversal rule for identifying at least one and less than eight bits whose values are to be reversed among 8 bits constituting unit data is defined.

Figure 4:
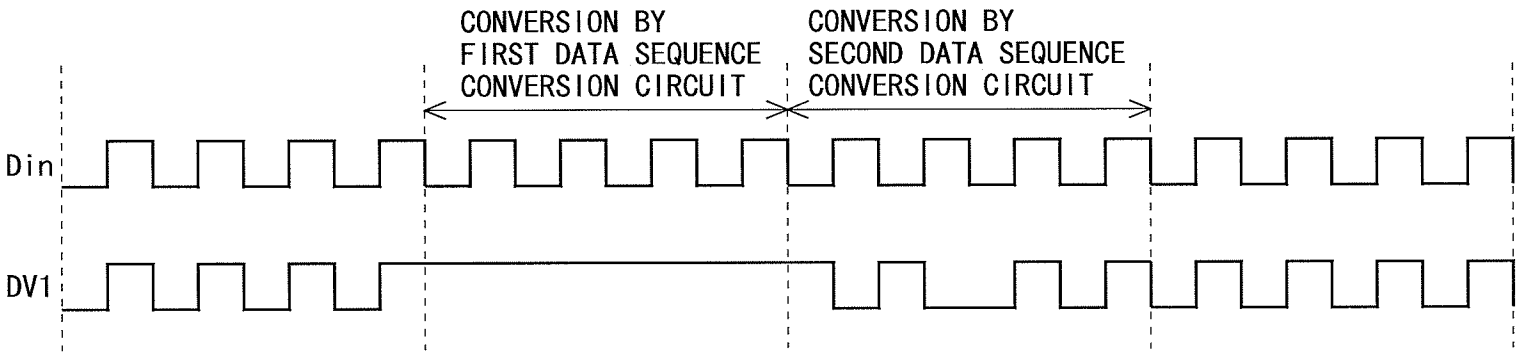
FIG. 4 is a signal waveform diagram for describing conversion of a data sequence in the embodiment.

Meanwhile, the first selector 110 selects the above-described three processes while sequentially switching between the processes every predetermined period of time, based on a control signal SEL1. For example, in the case where the first process, the second process, and the third process are sequentially switched on a unit-data-by-unit-data (8-bit data) basis, when an input image signal having a waveform indicated by the symbol "Din" in FIG. 4 is provided to the liquid crystal controller 10, then a digital video signal having a waveform indicated by the symbol "DV1" in FIG. 4 is transmitted from the liquid crystal controller 10 to the source driver 200. Note that the control signal SEL1 provided to the first selector 110 may be generated based on, for example, a timing signal TG sent from an external source, such that the three processes are sequentially switched every predetermined period of time.

<2.2 Operation Performed in the Source Driver>

Next, the operation of each component in the source driver 200 will be described. The second selector 210 switches the process for a digital video signal DV1 sent from the liquid crystal controller 10 between the following three processes. When a first process is selected, data sequence conversion is not performed on the digital video signal DV1, and the digital video signal DV1 is provided, as a digital video signal DV2, to a video signal output unit 230 in its original data sequence. When a second process is selected, the digital video signal DV1 is provided to the first data sequence restoring circuit 221. The first data sequence restoring circuit 221 performs the process of reversing the values of the even bits on each unit data in the same manner as the first data sequence conversion circuit 121, and outputs a digital video signal DV2 to be provided to the video signal output unit 230. Therefore, when a digital video signal DV1 having been subjected to data sequence conversion by the first data sequence conversion circuit 121 is provided to the first data sequence restoring circuit 221, the data sequence of a digital video signal DV2 outputted from the first data sequence restoring circuit 221 is the same as the data sequence of an input image signal Din. When a third process is selected, the digital video signal DV1 is provided to the second data sequence restoring circuit 222. The second data sequence restoring circuit 222 performs the process of reversing the values of the upper 4 bits on each unit data in the same manner as the second data sequence conversion circuit 122, and outputs a digital video signal DV2 to be provided to the video signal output unit 230. Therefore, when a digital video signal DV1 having been subjected to data sequence conversion by the second data sequence conversion circuit 122 is provided to the second data sequence restoring circuit 222, the data sequence of a digital video signal DV2 outputted from the second data sequence restoring circuit 222 is the same as the data sequence of an input image signal Din. The video signal output unit 230 receives the digital video signal DV2 and source control signals SS and applies a driving video signal to each source bus line.

Meanwhile, the second selector 210 selects the above-described three processes while sequentially switching between the processes every predetermined period of time, based on a control signal SEL2. In this regard, unit data having been subjected to data sequence conversion by the first data sequence conversion circuit 121 needs to be subjected to data sequence conversion again by the first data sequence restoring circuit 221, and unit data having been subjected to data sequence conversion by the second data sequence conversion circuit 122 needs to be subjected to data sequence conversion again by the second data sequence restoring circuit 222. Hence, in order that data sequence conversion of each unit data is performed by the liquid crystal controller 10 and the source driver 200 in the same manner, the configuration is such that the liquid crystal controller 10 generates a synchronizing signal and the synchronizing signal is provided, as the control signal SEL2, to the source driver 200.

Note that, in the present embodiment, a data sequence conversion step is implemented by data sequence conversion processes which are performed by the first data sequence conversion circuit 121 and the second data sequence conversion circuit 122, a data transmission step is implemented by the transmission of a digital video signal DV1 from the liquid crystal controller 10 to the source driver 200, and a data sequence restoring step is implemented by data sequence conversion processes which are performed by the first data sequence restoring circuit 221 and the second data sequence restoring circuit 222.

<3. Effects>

Figure 5:
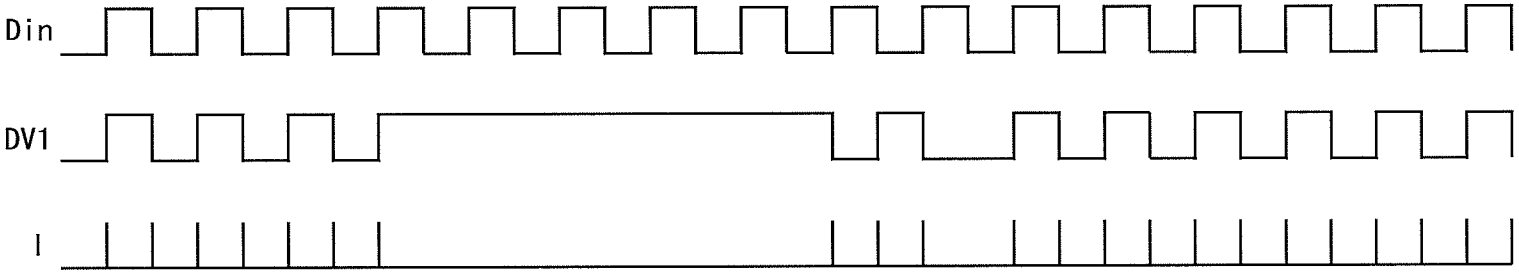
FIG. 5 is a signal waveform diagram for describing an effect obtained in the embodiment.

According to the present embodiment, upon transmission of image data from the liquid crystal controller 10 to the source driver 200 in the liquid crystal display device, the liquid crystal controller 10 sequentially performs three processes on the image data on a unit-data-by-unit-data basis, the three processes including "no conversion", "data sequence conversion by the first data sequence conversion circuit 121 (reversal of the values of the even bits)", and "data sequence conversion by the second data sequence conversion circuit 122 (reversal of the values of the upper 4 bits)". Hence, when an input image signal having a waveform indicated by the symbol "Din" in FIG. 5 is provided, as image data, to the liquid crystal controller 10, the waveform of a digital video signal transmitted from the liquid crystal controller 10 to the source driver 200 results in the waveform indicated by the symbol "DV1" in FIG. 5. At this time, current peaks occur as indicated by the symbol "I" in FIG. 5. From FIG. 5 and FIG. 11 (conventional example), it is grasped that in the present embodiment the frequency of the occurrence of current peaks is reduced, compared to the conventional example. As described above, according to the present embodiment, the liquid crystal display device can transmit image data whose data values change regularly in short fixed cycles, from the liquid crystal controller 10 to the source driver 200 while suppressing an increase in power consumption.

<4. Variants>

Variants of the embodiment will be described below.

<4.1 First Variant>

In the above-described embodiment, in order that data sequence conversion of each unit data is performed by the liquid crystal controller 10 and a source driver 200 in the same manner, the configuration is such that a synchronizing signal is provided from the liquid crystal controller 10 to the source driver 200. However, the present invention is not limited thereto. For example, the following configuration can also be employed.

Figure 6:
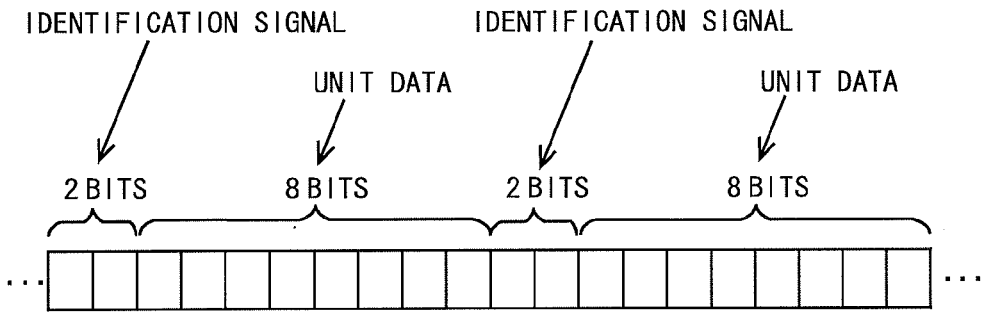
FIG. 6 is a diagram for describing addition of identification signals in a first variant of the embodiment.

In the present variant, an identification signal for identifying a process performed by the liquid crystal controller 10 is added to a digital video signal DV1 to be transmitted from the liquid crystal controller 10 to a source driver 200. For example, as shown in FIG. 6, a 2-bit identification signal is added on a unit-data-by-unit-data basis, the unit data constituting image data.

Figure 7:
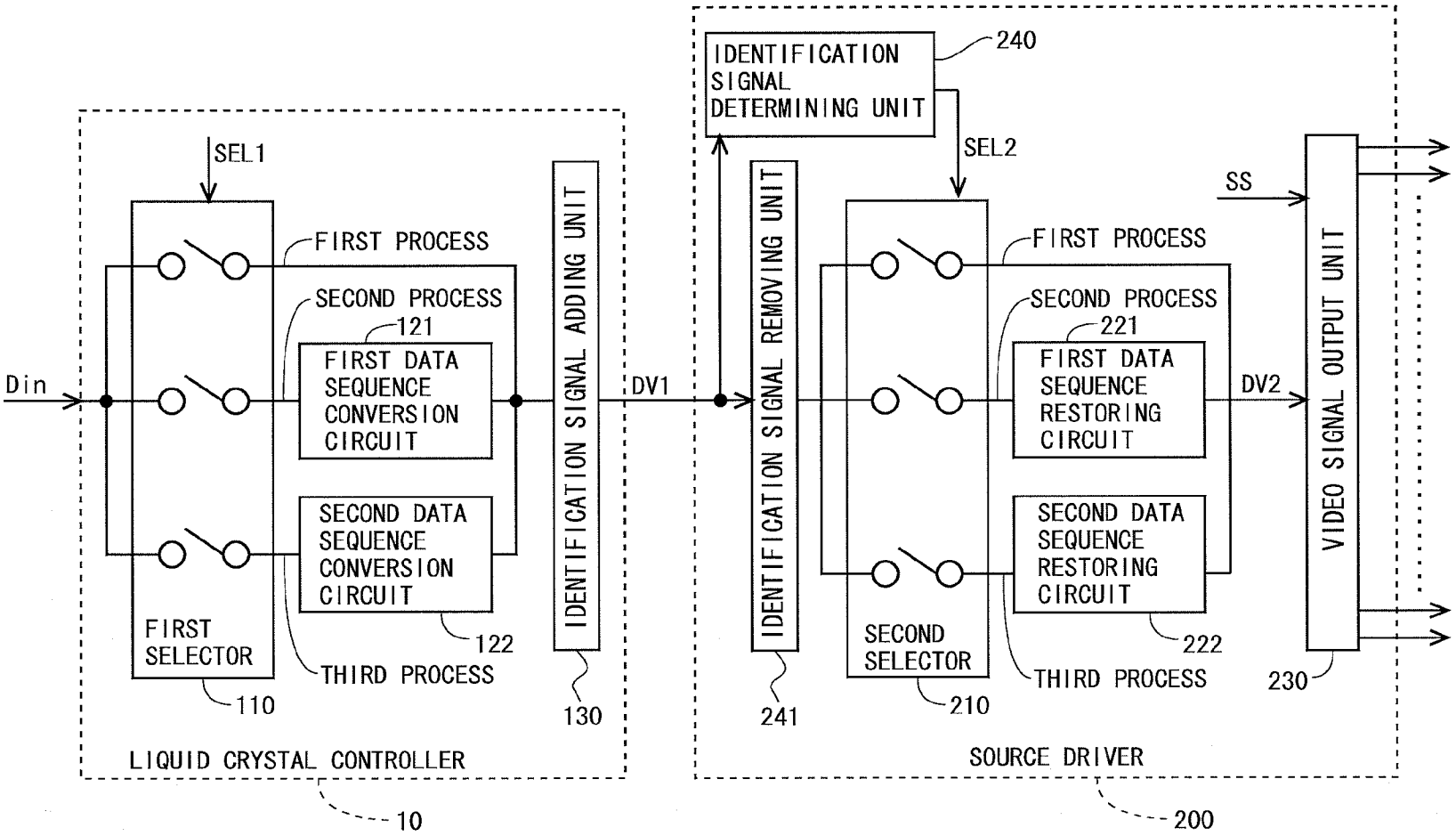
FIG. 7 is a block diagram showing a configuration of the main part related to the transmission of a digital video signal from a liquid crystal controller to a source driver in the first variant of the embodiment.

FIG. 7 is a block diagram showing a configuration of the main part related to the transmission of a digital video signal from the liquid crystal controller 10 to the source driver 200 in the present variant. In the present variant, in addition to the components in the above-described embodiment, the liquid crystal controller 10 is provided with an identification signal adding unit (bit adding unit) 130, and the source driver 200 is provided with an identification signal determining unit (bit value determining unit) 240 and an identification signal removing unit 241.

In the present variant, first, as in the above-described embodiment, the first to third processes are sequentially performed on an input image signal Din on a unit-data-by-unit-data basis. Thereafter, the identification signal adding unit 130 adds, on a unit-data-by-unit-data basis, a 2-bit identification signal having a value according to the content of a process performed by the liquid crystal controller 10, to a digital video signal DV1. Note that a bit addition step is implemented by this process. The digital video signal DV1 added with the identification signals is transmitted from the liquid crystal controller 10 to the source driver 200, and is provided to the identification signal determining unit 240 and the identification signal removing unit 241. The identification signal determining unit 240 determines, on a unit-data-by-unit-data basis, the processes performed by the liquid crystal controller 10, based on the identification signals added to the digital video signal DV1. The identification signal removing unit 241 removes the identification signals from the digital video signal DV1. A second selector 210 selects processes to be performed on the digital video signal DV1, based on the results of the determination made by the identification signal determining unit 240. By the operation such as that described above, data sequence conversion of each unit data is reliably performed by the liquid crystal controller 10 and the source driver 200 in the same manner.

<4.2 Second Variant>

Figure 8:
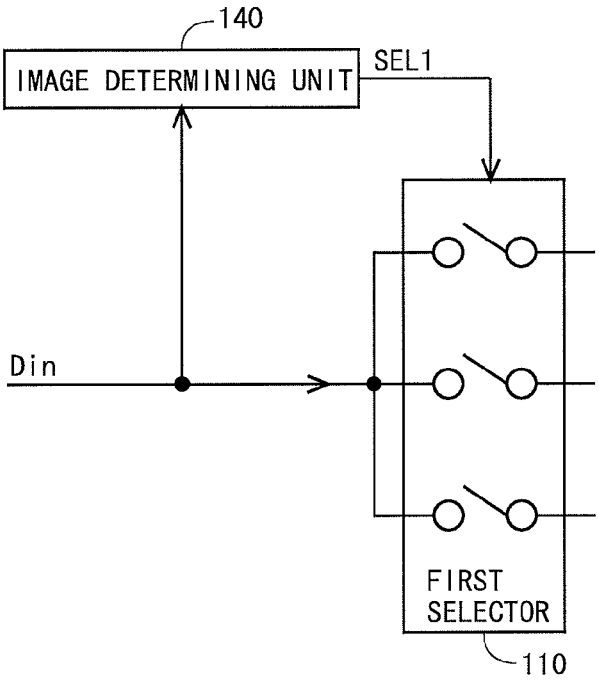
FIG. 8 is a block diagram for describing a second variant of the embodiment.

In the above-described embodiment, regardless of the content of an input image signal Din, the process of converting a data sequence is performed on the input image signal Din. However, when the input image signal Din is a moving image, it is considered that a great effect of reducing power consumption may not be obtained. Hence, the configuration may be such that the liquid crystal controller 10 includes an image determining unit 140 serving as a data determining unit that determines whether an input image signal Din is a moving image or a still image (see FIG. 8), and data sequence conversion is performed only when the input image signal Din is a still image. Specifically, when the input image signal Din is a moving image, both the liquid crystal controller 10 and the source driver 200 are allowed to select the first process (the process of outputting input data as it is without reversing the values of bits of each unit data). This enables to reduce the load on the liquid crystal controller 10 and the source driver 200. Note that a data determination step is implemented by the process performed by the image determining unit 140.

<4.3 Third Variant>

Figure 9:
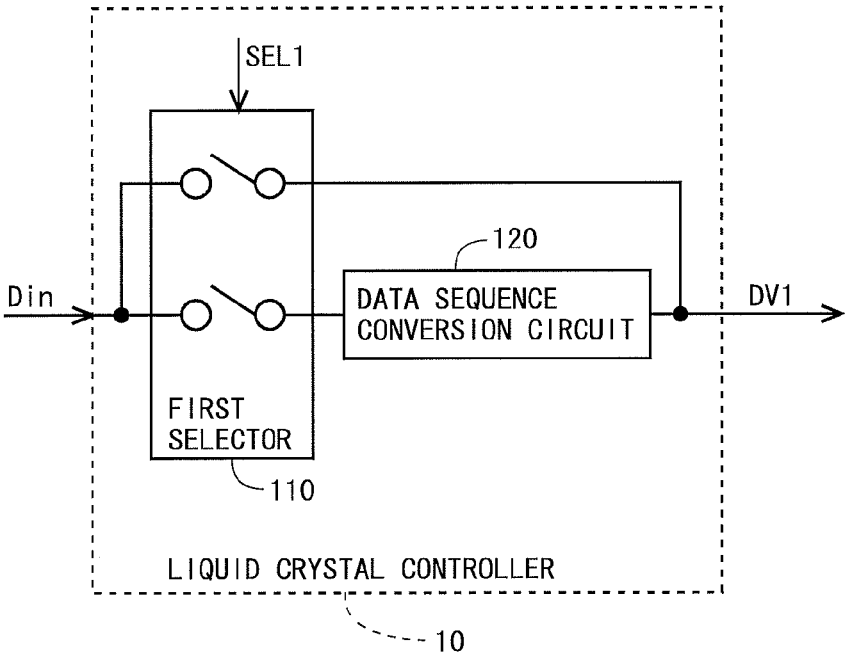
FIG. 9 is a block diagram showing a configuration of a liquid crystal controller in a third variant of the embodiment.
Figure 10:
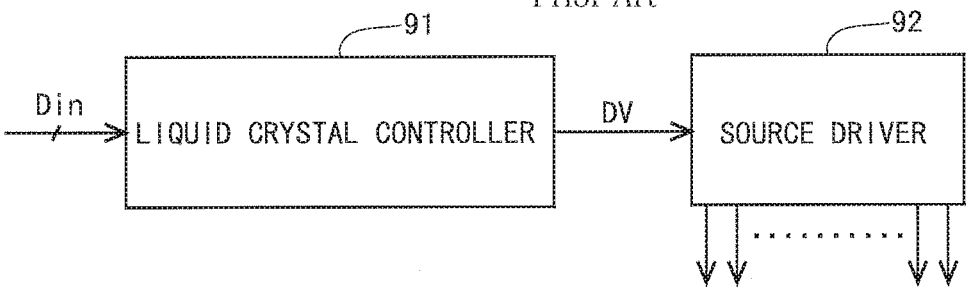
FIG. 10 is a block diagram for describing transmission of image data in a liquid crystal display device in a conventional example.

Although two data sequence conversion circuits are provided in the liquid crystal controller 10 and two data sequence restoring circuits are provided in the source driver 200 in the above-described embodiment, the present invention is not limited thereto. For example, the configuration may be such that only one data sequence conversion circuit 120 is provided in the liquid crystal controller 10 as shown in FIG. 9, or the configuration may be such that three or more data sequence conversion circuits are provided in the liquid crystal controller 10. Note, however, that data sequence restoring circuits need to be provided in the source driver 200 so as to have a one-to-one correspondence with the data sequence conversion circuits in the liquid crystal controller 10, and a reversal of the values of bits needs to be performed on unit data by a corresponding pair of a data sequence conversion circuit and a data sequence restoring circuit in the same manner.

<5. Others>

Although description is made using a liquid crystal display device as an example in the above-described embodiments, the present invention is not limited thereto. The present invention can also be applied to other display devices such as organic EL (Electro Luminescence).

In addition, the data transmission method according to the present invention can be applied not only to data transmission performed in a display device but also to data transmission performed between two devices that perform transmission and reception of serial data. In this regard, data to be transmitted and received may be data provided from an external source to a device on the transmitting side, or may be data generated in the device on the transmitting side.

The invention claimed is:

1. A data transmission method for performing serial transmission of data including unit data constituted by n bits from a transmitting circuit to a receiving circuit, wherein n is an integer greater than or equal to 2, the method comprising:

a data sequence conversion step of performing a first reversal process on transmission target data based on a predetermined reversal rule for identifying a bit whose value is to be reversed among the n bits constituting the unit data, the first reversal process reversing values of at least one and less than n bits on a unit-data-by-unit-data basis, the transmission target data being data provided to the transmitting circuit or data generated by the transmitting circuit;

a data determination step of determining content of the transmission target data;

a data transmission step of transmitting the data obtained in the data sequence conversion step from the transmitting circuit to the receiving circuit; and a data sequence restoring step of performing a second reversal process on the data transmitted to the receiving circuit in the data transmission step, the second reversal process reversing, on a unit-data-by-unit-data basis, the values of the bits having been subjected to the reversal of the values in the first reversal process, wherein whether to perform the first reversal process in the data sequence conversion step and the second reversal process in the data sequence restoring step is switched according to a result obtained in the data determination step.

2. The data transmission method according to claim 1, further comprising a bit addition step of adding, on a unit-data-by-unit-data basis, an identification bit having a value according to the reversal rule used in the first reversal process, wherein in the data sequence restoring step, the second reversal process is performed based on the reversal rule according to the value of the identification bit added to the unit data.

3. The data transmission method according to claim 1, wherein a plurality of reversal rules, each of which is identical to the reversal rule, are predetermined, and in the data sequence conversion step, the first reversal process is performed by sequentially using the plurality of reversal rules every predetermined period of time.

4. A display device comprising:

a video signal line drive circuit that drives a plurality of video signal lines for transmitting a video signal; and a control circuit that performs serial transmission of image data including unit data constituted by n bits to the video signal line drive circuit, wherein n is an integer greater than or equal to 2, the control circuit includes a data sequence conversion circuit that performs a first reversal process on the image data based on a predetermined reversal rule for identifying a bit whose value is to be reversed among the n bits constituting the unit data, the first reversal process reversing values of at least one and less than n bits on a unit-data-by-unit-data basis, and a data determination circuit that determines content of the image data, the video signal line drive circuit includes a data sequence restoring circuit that performs a second reversal process on the image data transmitted from the control circuit, the second reversal process reversing, on a unit-data-by-unit-data basis, the values of the bits having been subjected to the reversal of the values in the first reversal process, and whether to perform the first reversal process by the data sequence conversion circuit and the second reversal process by the data sequence restoring circuit is switched according to a result obtained by the data determining circuit.

5. The display device according to claim 4, wherein the control circuit further includes a bit adding circuit that adds, on a unit-data-by-unit-data basis, an identification bit having a value according to the reversal rule used in the first reversal process, the video signal line drive circuit further includes a bit value determining circuit that determines the value of the identification bit added to the unit data, and in the video signal line drive circuit, the second reversal process is performed by a data sequence restoring circuit selected based on a result of the determination made by the bit value determining circuit.

6. The display device according to claim 4, wherein the control circuit includes a plurality of data sequence conversion circuits that perform the first reversal process based on different reversal rules, the video signal line drive circuit includes a plurality of data sequence restoring circuits having a one-to-one correspondence with the plurality of data sequence conversion circuits, in the control circuit, the first reversal process is performed such that the plurality of data sequence conversion circuits are sequentially selected every predetermined period of time, and in the video signal line drive circuit, when the second reversal process is performed on each unit data, one of the data sequence restoring circuits corresponding to the data sequence conversion circuit selected by the control circuit is selected.

* * * * *